US011136166B2

(12) United States Patent
Holmi et al.

(10) Patent No.: US 11,136,166 B2
(45) Date of Patent: Oct. 5, 2021

(54) POUCH WITH FLEXIBLE SELF-SEALING DISPENSING VALVE

(71) Applicant: BEMIS COMPANY, INC., Neenah, WI (US)

(72) Inventors: Hanna M Holmi, Lansing, MI (US); Jordan R Tracy, Menasha, WI (US); Donald C Schnabel, Oshkosh, WI (US)

(73) Assignee: Bemis Company, Inc., Neenah, WI (US)

( * ) Notice: Subject to any disclaimer, the term of this patent is extended or adjusted under 35 U.S.C. 154(b) by 104 days.

(21) Appl. No.: 15/757,457

(22) PCT Filed: Sep. 28, 2015

(86) PCT No.: PCT/US2015/052568

§ 371 (c)(1),
(2) Date: Mar. 5, 2018

(87) PCT Pub. No.: WO2017/058138

PCT Pub. Date: Apr. 6, 2017

(65) Prior Publication Data

US 2018/0244435 A1 Aug. 30, 2018

(51) Int. Cl.

| | |
|---|---|
| ***B65D 35/46*** | (2006.01) |
| ***B65D 35/04*** | (2006.01) |
| ***B65D 35/10*** | (2006.01) |
| ***B65D 75/58*** | (2006.01) |
| ***B65D 75/00*** | (2006.01) |

(52) U.S. Cl.

CPC ..... *B65D 35/46* (2013.01); *B65D 35/04* (2013.01); *B65D 35/10* (2013.01); *B65D 75/008* (2013.01); *B65D 75/5877* (2013.01); *B65D 75/5894* (2013.01)

(58) Field of Classification Search

CPC ..... B65D 75/008; B65D 75/5877; B65D 75/5883; B65D 75/5866; B65D 75/5894; B65D 75/35; B65D 75/46; B65D 47/2031; B65D 33/2508–259

See application file for complete search history.

(56) References Cited

U.S. PATENT DOCUMENTS

| | | | | |
|---|---|---|---|---|
| 2,927,722 A * | 3/1960 | Metzger | F16K 15/144 383/94 |
| 3,380,646 A * | 4/1968 | Doyen | B65D 31/005 383/104 |
| 3,669,323 A * | 6/1972 | Harker | B65D 35/14 222/490 |

(Continued)

FOREIGN PATENT DOCUMENTS

| | | |
|---|---|---|
| EP | 0654418 A1 | 5/1995 |
| WO | 9801361 A1 | 1/1998 |

*Primary Examiner* — Paul R Durand
*Assistant Examiner* — Randall A Gruby
(74) *Attorney, Agent, or Firm* — Amy L. De Coster

(57) ABSTRACT

The present invention is directed to fluid-dispensing flexible pouches having at least a first wall portion, a second wall portion and a means to manually discharge a fluid product from inside the pouch. The means to manually discharge a fluid from inside the pouch comprises an orifice formed in either one of the first or second wall portions or a patch, and a flexible self-sealing dispensing valve having at least two intersecting lines of weakness formed in either one of the first or second wall portions or the patch.

10 Claims, 11 Drawing Sheets

(56) References Cited

U.S. PATENT DOCUMENTS 3,687,358 A 8/1972 Wink et al.
3,780,781 A 12/1973 Uramoto
3,827,472 A 8/1974 Uramoto
3,853,671 A 12/1974 Ausnit
RE28,969 E 9/1976 Naito
4,163,509 A 8/1979 Amneus
4,236,652 A 12/1980 Beguhn
4,269,330 A * 5/1981 Johnson ..... B65D 83/0005 222/386
4,353,497 A * 10/1982 Bustin ..... B65D 75/008 383/104
4,493,574 A 1/1985 Redmond et al.
4,553,693 A * 11/1985 Terajima ..... B65D 75/5894 229/103.1
4,762,514 A * 8/1988 Yoshida ..... B29C 59/007 219/121.67
5,018,646 A * 5/1991 Billman ..... B65D 75/5822 222/107
5,174,658 A 12/1992 Cook et al.
5,307,955 A * 5/1994 Viegas ..... B65D 47/2031 222/107
5,350,240 A * 9/1994 Billman ..... B65D 75/008 383/104
5,494,192 A * 2/1996 Redmond ..... B65D 75/367 222/107
5,529,224 A 6/1996 Chan et al.
5,709,479 A * 1/1998 Bell ..... B65D 75/008 383/10
5,772,332 A * 6/1998 Geller ..... B29C 65/18 220/9.1
D396,002 S * 7/1998 Bell ..... D9/707
5,894,957 A 4/1999 Egel
6,076,968 A * 6/2000 Smith ..... B65D 75/008 383/202
6,079,594 A * 6/2000 Brown ..... B29C 45/14344 222/107
6,164,825 A * 12/2000 Larkin ..... B65D 75/008 383/104
6,427,874 B2 8/2002 Brown et al.
D468,195 S * 1/2003 Bell ..... D9/707
6,530,504 B2 * 3/2003 Socier ..... B65D 47/2031 222/212
6,598,764 B1 7/2003 Stern
D478,504 S * 8/2003 Crozet ..... D9/708
6,685,691 B1 * 2/2004 Freund ..... A61J 1/10 222/105
6,705,492 B2 3/2004 Lowry
6,912,825 B2 * 7/2005 Kothari ..... B65B 9/093 206/217
6,932,509 B2 * 8/2005 Shah ..... B65D 33/01 383/103
6,983,845 B2 * 1/2006 Shah ..... B65D 33/01 206/524.8
7,021,827 B2 * 4/2006 Compton ..... B65B 9/02 383/205
7,051,762 B2 * 5/2006 Haamer ..... B65D 77/225 137/855
7,137,738 B2 * 11/2006 Shah ..... B65D 33/01 383/103
RE39,520 E * 3/2007 Hess, III ..... B65D 5/746 222/105
7,244,223 B2 * 7/2007 Hartman ..... B65D 77/225 383/103
7,284,681 B2 * 10/2007 Hagihara ..... B65D 47/2018 222/107
7,331,715 B2 * 2/2008 Miller ..... B65D 33/2508 383/100
7,410,452 B2 * 8/2008 Nishibe ..... B65D 75/5894 493/116
7,422,369 B2 * 9/2008 Bergman ..... B65D 81/2038 383/103
D607,343 S * 1/2010 Poirier ..... D9/707
7,665,894 B2 * 2/2010 DeBlander ..... B65D 33/08 383/9
7,726,880 B2 * 6/2010 Zimmerman ..... B65D 81/2038 383/100
7,775,399 B2 8/2010 Wood
7,857,514 B2 * 12/2010 Gaikwad ..... B65D 33/2541 383/59
8,430,266 B2 4/2013 Barton
D694,649 S * 12/2013 Ferber ..... D9/708
8,628,056 B2 * 1/2014 LaBean ..... B65D 47/2031 251/149.1
D699,128 S * 2/2014 Moynihan ..... D9/707
8,858,077 B2 * 10/2014 Shepard ..... B65D 33/24 383/63
D716,668 S * 11/2014 James ..... B65D 75/008 D9/709
8,960,502 B2 2/2015 Stehli, Jr. et al.
9,296,521 B2 * 3/2016 Murray ..... B65D 33/02
9,481,495 B2 * 11/2016 Bellmore ..... B65D 83/0072
9,694,944 B2 * 7/2017 Long ..... B65D 35/08
9,701,456 B2 * 7/2017 Franca ..... B65D 31/04
9,957,101 B2 * 5/2018 Rasmussen ..... A47J 31/18
D860,003 S * 9/2019 Wiesman ..... D9/708
10,421,584 B2 * 9/2019 Ross ..... B65D 33/08
11,014,717 B2 * 5/2021 Nicholls ..... B65D 47/10
2004/0234174 A1 * 11/2004 Caudle ..... B29C 65/7891 383/104
2005/0238264 A1 * 10/2005 Ikeda ..... B65D 75/008 383/120
2006/0228057 A1 * 10/2006 Newrones ..... B31D 1/026 383/103
2007/0110340 A1 * 5/2007 Buchman ..... B65D 33/2533 383/5
2008/0240626 A1 * 10/2008 Bell ..... B65D 31/10 383/120
2008/0247684 A1 * 10/2008 Binks ..... B65D 49/02 383/113
2008/0310774 A1 12/2008 Turvey et al.
2009/0238495 A1 * 9/2009 Anderson ..... A61J 1/10 383/7
2010/0022374 A1 * 1/2010 Nagano ..... B31B 70/844 493/189
2011/0108572 A1 * 5/2011 Murray ..... B65D 75/5877 222/83
2013/0195382 A1 * 8/2013 Murray ..... B65D 75/008 383/10
2013/0233886 A1 9/2013 Long et al.
2014/0166699 A1 6/2014 Stehli, Jr. et al.
2014/0231452 A1 * 8/2014 James ..... B65D 75/008 222/105
2014/0248005 A1 9/2014 Nicholas et al.
2016/0023819 A1 * 1/2016 Maldonado ..... B65D 47/103 222/92
2018/0244010 A1 * 8/2018 Nil ..... B65B 43/52

* cited by examiner

POUCH WITH FLEXIBLE SELF-SEALING DISPENSING VALVE

BACKGROUND OF THE INVENTION

The present invention relates generally to primary packaging for fluid or viscous products and the like, and in particular to pouches having a flexible self-sealing dispensing valve.

Many different types of packages or containers are presently available for packaging non-solid products of the type which are capable of flowing, such as fluid or fluidized materials, including liquids, pastes, powders, and the like, which substances are collectively and generically referred to herein as "fluids". Fluid material also includes viscous food products like pancake batter, syrups and various types of condiments that include mayonnaise, guacamole, ketchup and mustard. Such foods are often provided to restaurants and food service providers in rigid or flexible plastic tubes. Some such packages include a dispenser which permits a selected amount of fluid to be discharged from the package, and then reseals to close the package. Typically, these self-sealing dispensing values are formed rigid plastic fitments heat fused or adhesively sealed to a flexible tube or pouch.

SUMMARY OF THE INVENTION

The present invention is directed to flexible fluid-dispensing pouches having at least a first wall portion, a second wall portion and a means to manually discharge a fluid product from inside the pouch. The means to manually discharge a fluid from inside the pouch comprises an orifice formed in either one of the first or second wall portions or a patch, and a flexible self-sealing dispensing valve having at least two intersecting lines of weakness formed in either one of the first or second wall portions or the patch. The means to manually discharge a fluid from inside the pouch may be configured such that either: (i) the orifice is formed in one of the first or second wall portions, and the flexible self-sealing dispensing valve is formed in the patch and the patch is superimposed over the orifice; or (ii) the flexible self-sealing dispensing valve is formed in one of the first or second wall portions, and the orifice is formed in the patch and the patch is superimposed over the flexible self-sealing dispensing valve.

As used herein, the phrase "flexible self-sealing dispensing valve" refers to a frangible discharge area formed in either one of the first, second or third wall portions of the pouch or a patch applied to the pouch. The valve is created by at least two intersecting lines of weakness that define three of more sections in the wall portion or in the patch which open in response to an applied force supplied by a fluid product contained therein and close themselves when the deflection force is removed. The efficacy of the self-sealing dispensing valve, i.e., the tightness of the discharge area, will depend on the resilience or stiffness of the material surrounding the valve and the material from which the valve is made.

Surprisingly, it was discovered that this resilience or stiffness can be controlled more effectively by the combination of an orifice and a flexible self-sealing dispensing valve when each is superimposed over the other in the construction of the pouch. When a fluid product inside the pouch is urged against the combined orifice and valve by manually squeezing the pouch, the sections formed by the intersecting lines of weakness of the valve must bend outwardly to permit the product to flow out of the pouch. The orifice provides additional bending resistance to the sections of the valve and limits the amount of the fluid product passing through the valve. Typically, the higher the viscosity of the product, the more force is required to bend the flexible sections outwardly. Generally, it is easier to manually control larger amounts of force than smaller amounts of force. It becomes more difficult to control the amount of low viscosity products exiting the pouch because the valve sections require a relatively weak force to bend outwardly with these products. With the combined orifice and valve of the present invention, the amount of force required to bend valve sections can be augmented for low viscosity products. The bending force of the valve sections can be readily controlled for both low and high viscosity products by one or more of the following stiffness parameters: the material used to form the orifice, the thickness of the material and the size of the orifice, and the material used to form the valve and its thickness, and the size of valve sections formed by the at least two lines of weakness. When the force used to deflect the valve sections is removed, the sections return to their original position and close the opening in the pouch.

Thus, the present invention advantageously provides a pouch having a means to manually discharge a fluid product from inside the pouch that can be tailored to permit its use with products of various viscosities. The option of configuring the means to manually discharge a fluid by either: (i) an orifice formed in one of the first or second wall portions and a flexible self-sealing dispensing valve formed in the patch which is superimposed over the orifice: or (ii) a flexible self-sealing dispensing valve formed in one of the first or second wall portions and an orifice formed in the patch with the patch superimposed over the flexible self-sealing dispensing valve adds more flexibility to adjust the stiffness parameters to meet the needs of a particular desired application.

In some preferred embodiments, the first wall portion forms a front panel of the pouch, and the second wall portion forms a rear panel of the pouch.

In other preferred embodiments, the pouch further comprises a third wall portion. In such embodiments, the first wall portion forms a front panel of the pouch, the third wall portion forms a rear panel of the pouch, and the second wall portion forms a bottom gusset which is disposed between the front and rear panels of the pouch.

In some preferred embodiments, the first and third wall portions are formed from a first film and the second wall portion is formed from a second film.

In other preferred embodiments, the first film is flexible and the second film is rigid or semi-rigid.

In still other preferred embodiments, the first, second and third wall portions are formed from a single film. In such embodiments, the single film may be flexible.

BRIEF DESCRIPTION OF THE DRAWINGS

Further features and advantages of the present invention will become apparent from the following detailed description, taken in combination with the appended drawings, in which.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
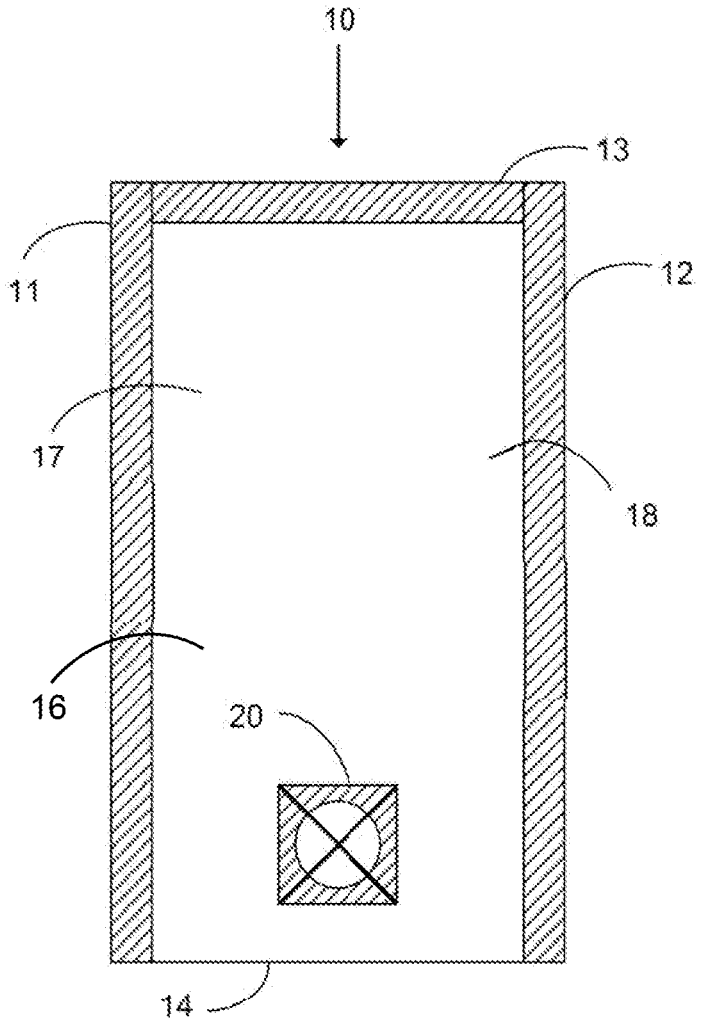
FIG. 1 illustrates a schematic of one embodiment of a flexible fluid-dispensing pouch having two wall portions according to the present invention.

One preferred embodiment of flexible fluid-dispensing pouch 10 of the present invention is illustrated in FIG. 1. In this particular embodiment, pouch 10 is configured as a pillow pouch. It should be understood that pouch 10 may be of any shape desired, such as, for example, rectangular, square, and circular or polygon and may have any internal volume depending on both functional and aesthetic requirements of a particular packaging application. Generally, pouch 10 includes at least a first side edge 11, an opposing second side edge 12, a top edge 13 and an opposing bottom edge 14, an inner surface 15 (not shown) and an opposing outer surface 16; a first wall portion 17, a second wall portion 18, and a discharge means 20 to manually discharge a fluid product 26 (not shown) from inside the pouch 10. Pouch 10 further includes heat seals adjacent to first side edge 11, opposing second side edge 12, and top edge 13. The discharge means 20 is a two component system which includes an orifice 21 (shown in FIGS. 2-5) in either one of the first or second wall portions 17, 18 or a patch 23 (shown in FIGS. 2-5), and a flexible self-sealing dispensing valve 22 (shown in FIGS. 2-5) in either one of the first or second wall portions 17, 18 or the patch 23 whichever does not include orifice 21. The discharge means 20 may be positioned anywhere on the pouch. The first and second wall portions 17 18 of the pouch may be made from any conventional film or film laminate known to those skilled in the art. For example, in some preferred embodiments, the first and second wall portions 17, 18 are formed from a single film laminate having the structure: oriented polyethylene terephthalate (OPET)//adhesive/polyethylene (PE)/anhydride-modified polyethylene (tie)/ethylene vinyl alcohol (EVOH)/anhydride-modified polyethylene (tie)/polyethylene (PE). The total thickness of such preferred embodiments of films and film laminates may vary from about 19.1 μm (0.75 mil) to about 254 μm (10 mil), most typically from about 63.5 μm (2.5 mil) to about 127 μm (5.0 mil).

Figure 2:
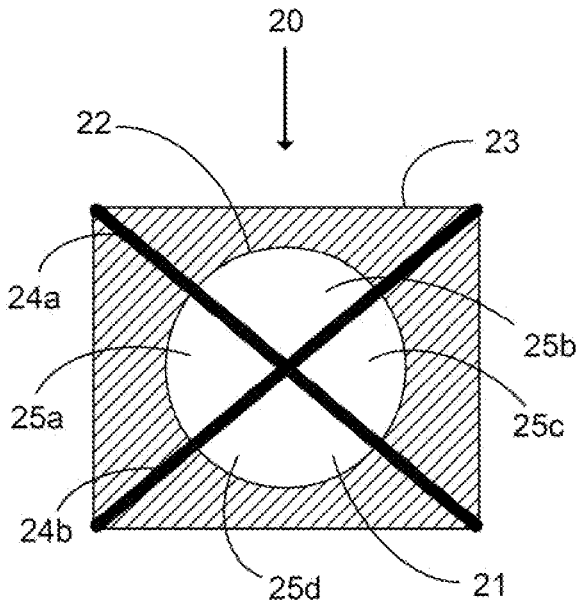
FIG. 2 illustrates a schematic view of one embodiment of a flexible self-sealing dispensing valve in a "closed" state according to the present invention.

FIG. 2 is an enlarged view of a discharge means 20 having a flexible self-sealing dispensing valve 22 in a "closed" state. Valve 22 may be created by at least two intersecting lines of weakness 24*a* and 24*b* in either one the first or second wall portions 17, 18 or the patch 23. The lines of weakness, 24*a* and 24*b*, are made by cutting or slitting one or more layers used to construct the first or second wall portion 17 or 18 or patch 23 such that the first or second wall portion 17 or 18 or patch 23 may be ruptured with a controlled manual force. In a preferred embodiment, the lines of weakness 24*a* and 24*b* are cuts or slits which do not penetrate through the entire thickness of the first or second wall portion 17 or 18 or patch 23. In this preferred embodiment, lines of weakness, 24*a* and 24*b* create valve sections, 25*a*, 25*b*, 25*c*, and 25*d*. Orifice 21 may be created in either one of the first or second wall portions 17 and 18 or the patch whichever does not include valve 22.

Figure 3:
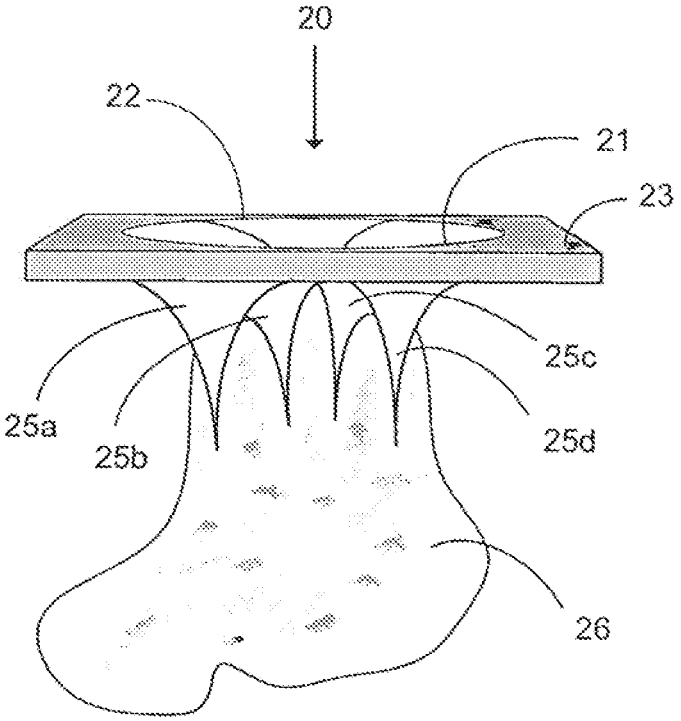
FIG. 3 illustrates a schematic view of one embodiment of a flexible self-sealing dispensing valve in an "open" state according to the present invention.

FIG. 3 is a cross-sectional view of discharge means 20 depicted in FIG. 2 in an "open" state. When force is applied to valve 22 by manually squeezing the pouch 10, the lines of weakness 24*a* and 24*b* facilitate the rupturing of valve sections, 25*a*, 25*b*, 25*c*, and 25*d* which break apart from each other and bend outwardly to release a fluid product 26. In another preferred embodiment, the lines of weakness 24*a* and 24*b* can be arranged such that there are three valve sections.

Figure 4:
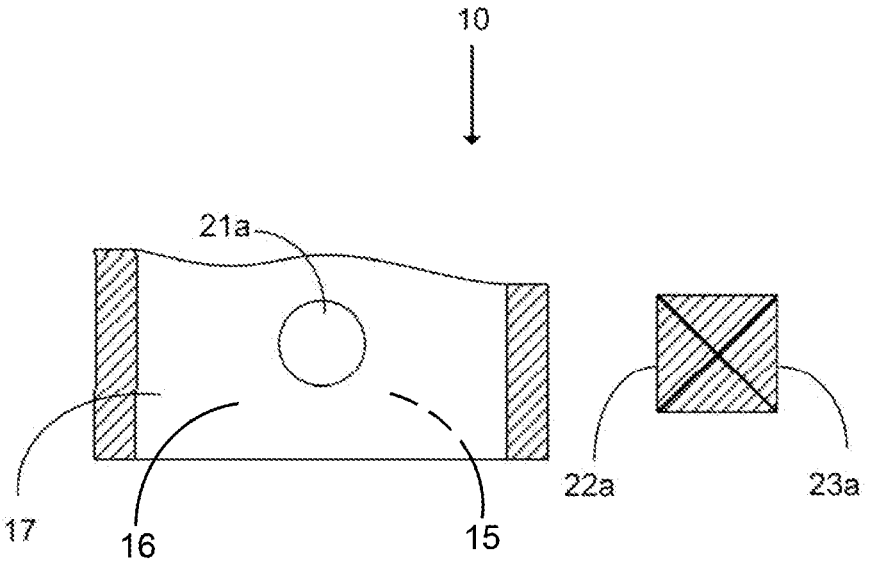
FIG. 4 illustrates an isolated close-up exploded view of a pouch with an orifice formed in first wall portion and a flexible self-sealing dispensing valve formed in patch which has been separated from the pouch.
Figure 5:
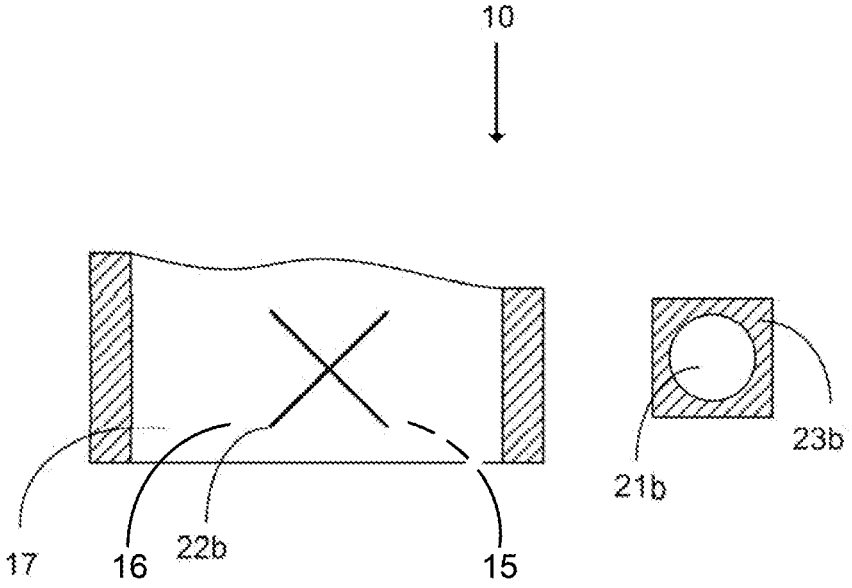
FIG. 5 illustrates an isolated close-up exploded view of a pouch with a flexible self-sealing dispensing valve formed in first wall portion and an orifice formed in a patch which has been separated from the pouch.

To illustrate the discharge means 20 in greater detail, attention should be drawn to FIGS. 4 and 5. The discharge means 20 may be configured in two different ways. The first configuration shown in FIG. 4 includes an orifice 21*a* formed in first wall portion 17 and a flexible self-sealing dispensing valve 22*a* formed in a patch 23*a*. To better clarify this configuration, FIG. 4 depicts an isolated close-up exploded view of pouch 10 with the orifice 21*a* formed in first wall portion 17 and the flexible self-sealing dispensing valve 22*a* formed in patch 23*a* that has been separated from the pouch. In use, the patch 23*a* is applied to either the inner surface 15 or outer surface 16 of the pouch. In this particular preferred embodiment, the orifice 21*a* is considered to be an integral part of the first wall portion 17 formed by creating an opening through the first wall portion 17. The opening may be sized and shaped to any dimension depending upon the particular fluid product 26 to be dispensed from the pouch 10. Orifice 21*a* should be considered surrounded by patch 23*a*.

Alternatively, an orifice 21*b* may be formed in a patch 23*b* and a flexible self-sealing dispensing valve 22*b* formed in in first wall portion 17. To better illustrate this second configuration, attention should be drawn to FIG. 5 which that shows an isolated close-up exploded view of pouch 10 with the flexible self-sealing dispensing valve 22*b* formed in first wall portion 17 and the orifice 21*b* formed in a patch 23*b* which has been separated from the pouch 10. In use, patch 23*b* is applied to either the inner surface 15 or outer surface 16 of the pouch 10.

In one preferred embodiment, patch 23 has a multilayer construction of at least a first layer having the lines of weakness formed therein and a second layer of an adhesive, preferably a pressure sensitive adhesive coated onto the first layer. The first layer may include a multilayer film having any number of layers, including but not limited to one or more of the following: a moisture barrier layer, an oxygen barrier layer, and an abuse layer. In another preferred embodiment, patch 23 may include a multilayer construction having a heat sealable layer which permits patch 23 to be heat sealed to either the inner or outer surface of the pouch. In one preferred embodiment, the wall portions of pouch 10 may be formed the single film laminate described above with the patch heat sealed on the polyethylene (PE) exterior face of the wall portion. In this embodiment, the patch may be formed from a collapsed bubble film having the structure: polyethylene (PE)/anhydride-modified polyethylene (tie)nylon/ethylene vinyl alcohol (EVOH)/nylon/anhydride-modified polyethylene (tie)/ethylene vinyl acetate (EVA)/anhydride-modified polyethylene (tie)/nylon/ethylene vinyl alcohol (EVOH)/nylon/anhydride-modified polyethylene (tie)/polyethylene (PE). The total thickness of some preferred embodiments of suitable films and film laminates for use as patches may vary from about 191 μm (0/5 mil) to about 254 μm (10 mil), most typically from about 63.5 μm (2.5 mil) to about 127 μm (5.0 mil).

Figure 6:
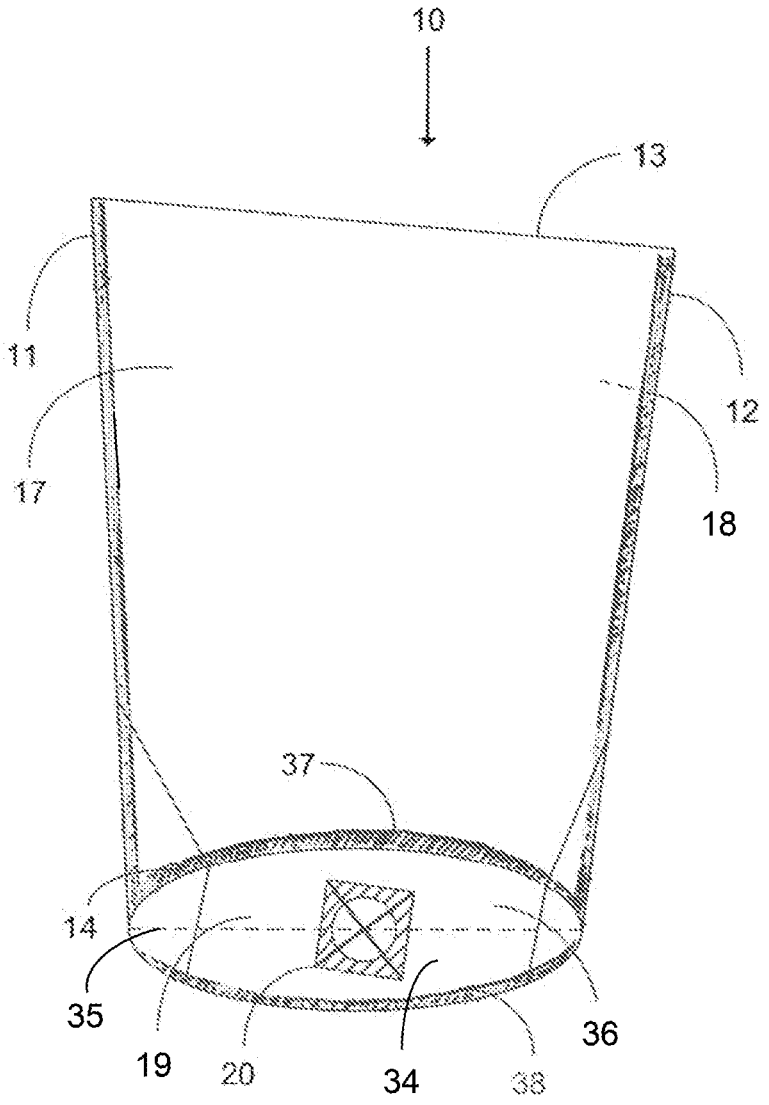
FIG. 6 illustrates a schematic of one embodiment of a flexible fluid-dispensing pouch having three wall portions where one of the wall portions is a bottom gusset according to the present invention.
Figure 7:
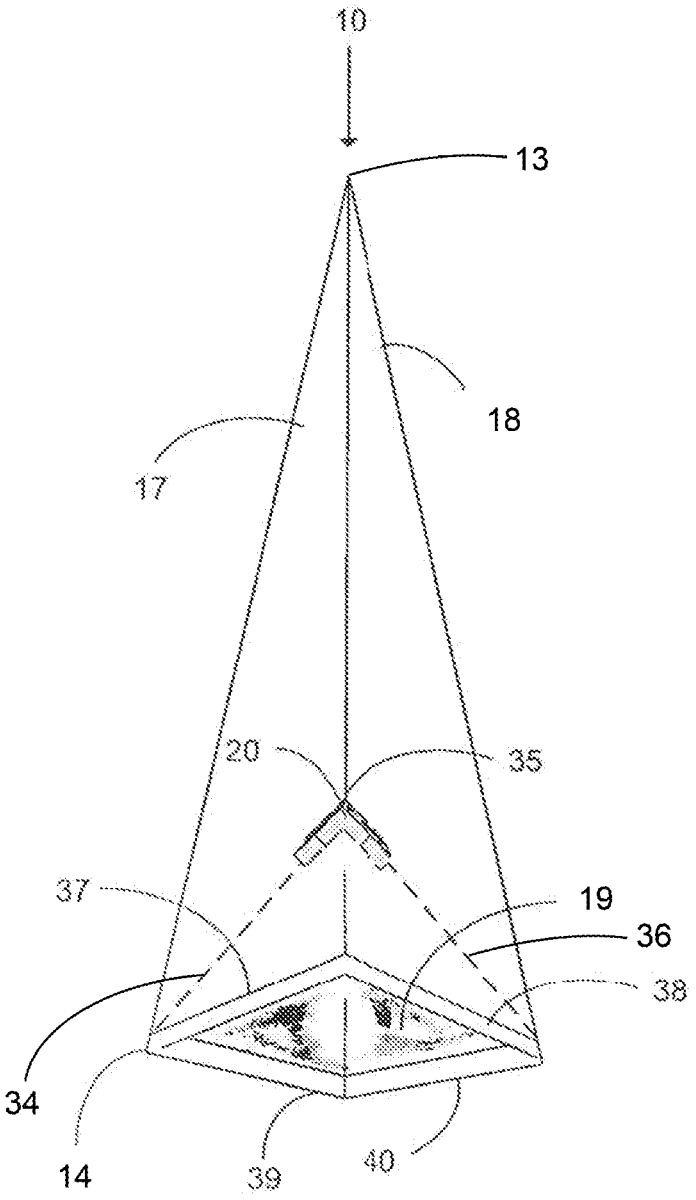
FIG. 7 illustrates a side view of the pouch depicted in FIG. 6.
Figure 8:
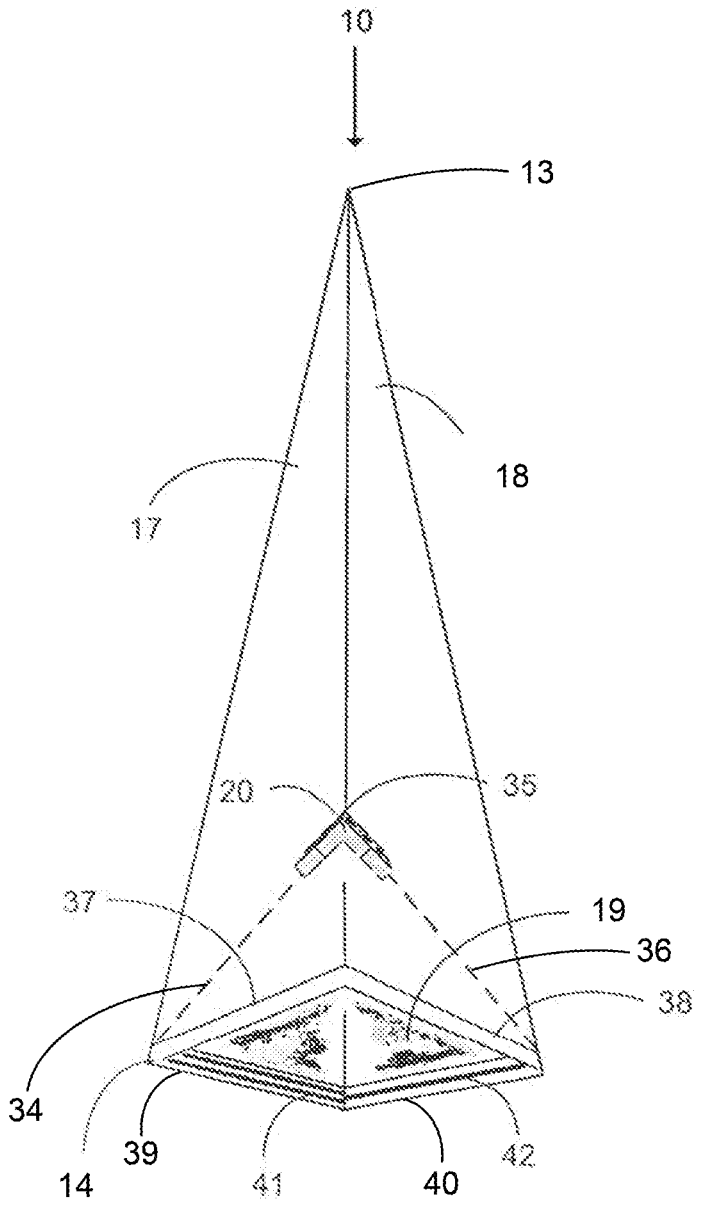
FIG. 8 illustrates a side view of the pouch depicted in FIG. 6 having reclosable fasteners affixed to the bottom gusset.
Figure 9:
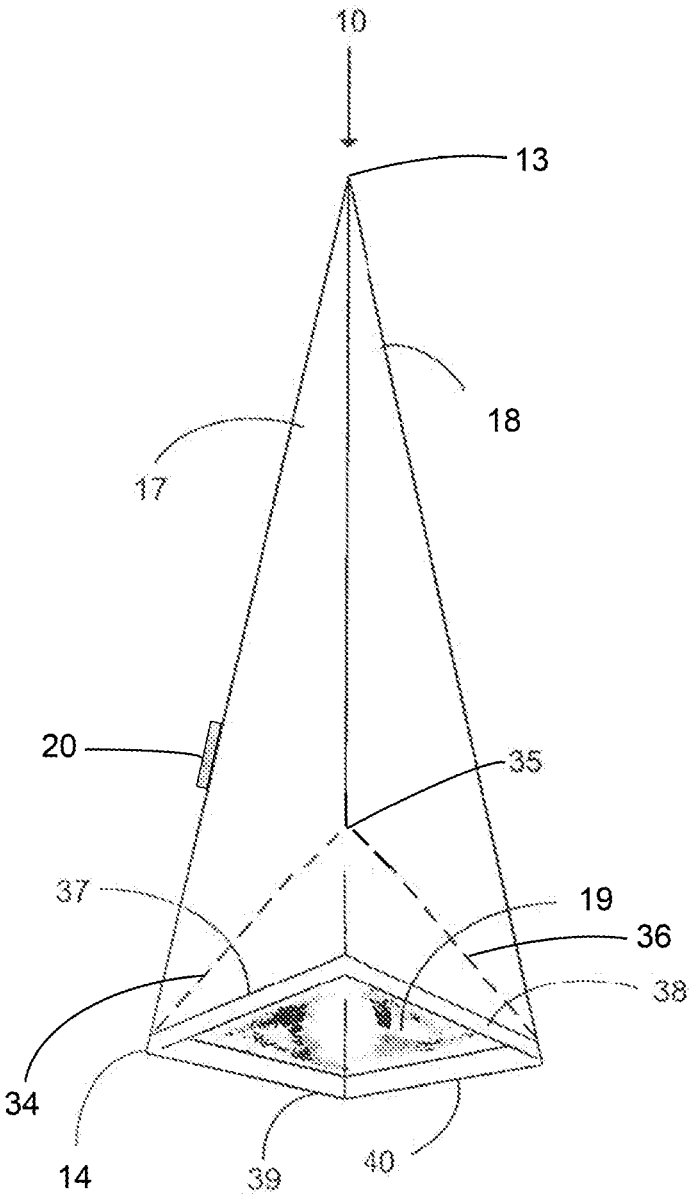
FIG. 9 illustrates a side view of one embodiment of a fluid-dispensing pouch having three wall portions according to the present invention.

In an alternative embodiment, pouch 10 of the present invention may further comprise a third wall portion 19 as illustrated in FIGS. 6-1O. In such preferred embodiments, the third wall portion 19 forms a bottom gusset 33 disposed between the first wall portion 17 and the second wall portion 18. The pouches of the present invention may include any number of wall portions and gussets as desired. Gussets are known in the art and can be fabricated using any conventional technique known to those skilled in the art and may be formed from either a flexible or a rigid/semi-rigid film. As is illustrated in FIGS. 6-8, the discharge means 20 is formed in the third wall portion 19. With reference to FIG. 6, the third wall portion 19 is shown in an unfolded (expanded) configuration. The third wall portion 19 may comprise a first outermost fold 34, an innermost fold 35 and a second outermost fold 36. The innermost fold 35 is a line that demarcates the first outermost fold 34 and the second outermost fold 36. The first outermost fold 34 is a first portion of the third wall portion 19 and the second outermost fold 36 is a second portion of the third wall portion 19. The innermost fold 35 is a line upon which the third wall portion 19 may be folded or bent. Turning now to FIG. 7, there is shown a side view of pouch 10 of FIG. 6 that includes the third wall portion 19 folded along the innermost fold 35 in a partially folded (unexpanded) configuration. In this configuration, the innermost fold 35 is oriented towards the top edge 13 of the pouch 10 and is disposed between the first and second outermost folds 34 and 36. The first and second outermost folds 34 and 36 are each oriented towards the opposing bottom edge 14 of the pouch 10 in a "W" configuration where the innermost fold 35 is comparable to the central peak of the "W" and the lowermost points of the "W" are comparable to where the bottom edge 14 of the pouch 10 joins to the first and second outermost folds 34 and 36. In such embodiments folded configurations of the third wall portion 19, the discharge means 20 is located at the vertex (e.g., central peak of "W") of the innermost fold 35. In some preferred embodiments, the pouches of the present invention may further include a first transverse heat seal 37 disposed adjacent to the bottom edge 14 of the first wall portion 17 and extending between the first and opposing second side edges, 11 and 12 to form an inner bottom end margin of the first wall portion 39 front panel. In these embodiments, there is also a second transverse heat seal 38 disposed adjacent to the bottom edge of the second wall portion 18 extending between the first and opposing second side edges 11 and 12 of the pouch 10 to form an inner bottom end margin of the second wall portion 40. In other embodiments that include the third wall portion 19, the discharge means 20 may be located in the first wall portion 17, shown in FIGS. 9 and 10, or in the second wall portion 18 (not shown).

Figure 10:
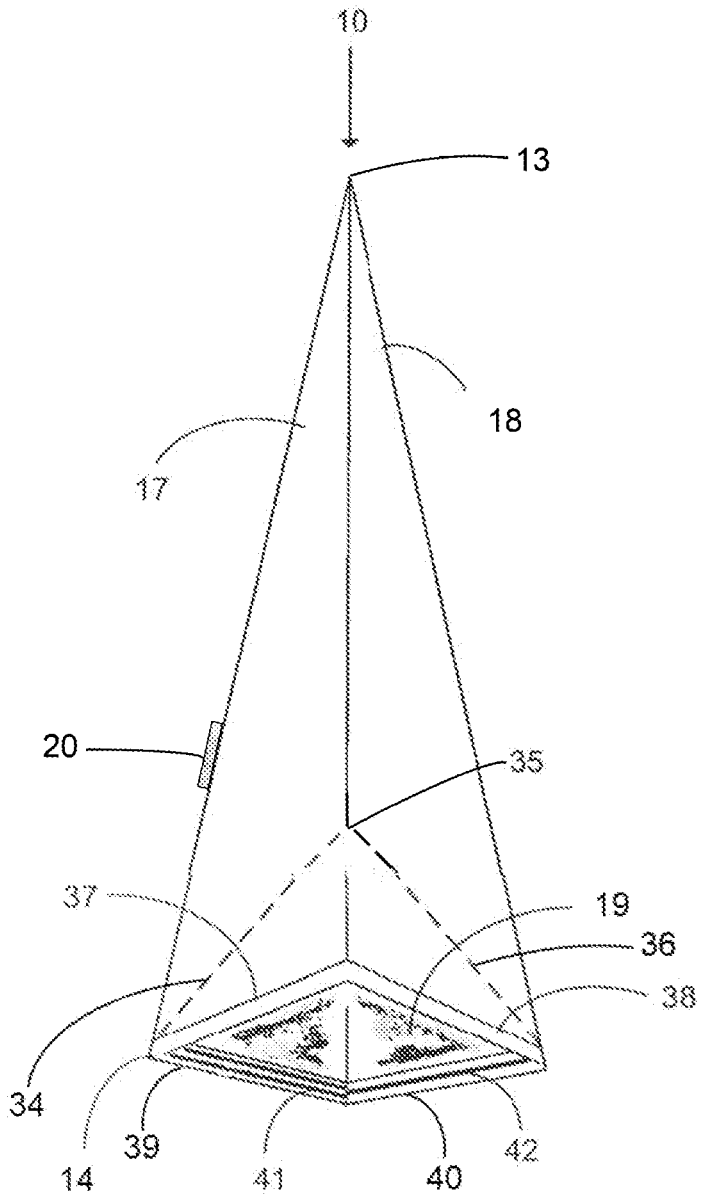
FIG. 10 illustrates a side view of one embodiment of a fluid-dispensing pouch having three wall portions according to the present invention that includes reclosable fasteners.

In yet further preferred embodiments as illustrated in FIGS. 8 and 10, the pouches of the present invention may also include a first closure member 41 affixed to the inner bottom end margin of the first wall portion 39, and a second closure member 42 affixed to the inner bottom end margin of the second wall portion 40. Such closure members have an interlocking rib and groove mechanism which is well-known in the art. Various examples of this type of reclosable fastener have been described in the literature, such as for examples in U.S. Pat. Nos. 3,780,781; 3,827,472; 3,853,671; and U.S. RE28,969, the disclosures of which are incorporated herein by reference in their entireties.

Figure 11A:
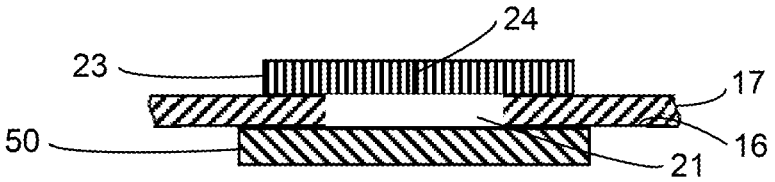
FIGS. 11A-B illustrate cross-sectional views of embodiments of fluid-dispensing pouches that include an adhesive label applied to the outer surface of the pouch that covers the discharge means.
Figure 11B:
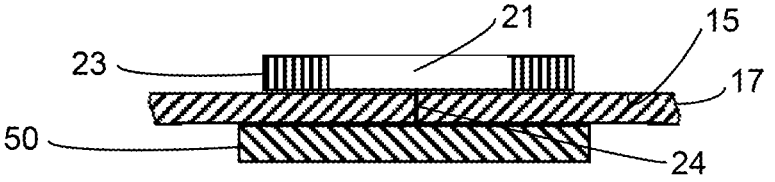

With reference to FIGS. 11A-B, in other embodiments the pouch 10 may include an adhesive label 50. The adhesive label 50 can be applied to the outer surface 16 of the first wall portion 17 as shown, or the second or third wall portions 18 or 19 (not shown). In an exemplary embodiment shown in FIG. 11A, the adhesive label 50 directly covers an orifice 21 in the first wall portion 17 and a patch 23 including lines of weakness 24 is applied to the inner surface of the first wall portion 17. In another exemplary embodiment shown in FIG. 11B, the adhesive label 50 covers lines of weakness 24 in the first wall portion 17 and a patch 23 including an orifice 21 is applied to the inner surface 15 of the first wall portion 17.

The above description and examples illustrate certain embodiments of the present invention and are not to be interpreted as limiting. Selection of particular embodiments, combinations thereof, modifications, and adaptations of the various embodiments, conditions and parameters normally encountered in the art will be apparent to those skilled in the art and are deemed to be within the spirit and scope of the present invention.

What is claimed is:

1. A flexible fluid-dispensing pouch comprising:

a first side edge, an opposing second side edge, a top edge and an opposing bottom edge, an inner surface and an opposing outer surface;

a first wall portion, a second wall portion;

a discharge means to manually discharge a fluid product from inside the pouch comprising:

an orifice formed in either one of the first or second wall portions ora patch applied to one of the first or second wall portions;

a flexible self-sealing dispensing valve having two intersecting lines of weakness formed in either one of the first or second wall portions or the patch; wherein the patch is a film; and wherein the means to manually discharge a fluid is configured such that either:

(i) the orifice is formed in one of the first or second wall portions and the flexible self-sealing dispensing valve is formed in the patch and the patch is superimposed over the orifice; or (ii) the flexible self-sealing dispensing valve is formed in one of the first or second wall portions and the orifice is formed in the patch and the patch is superimposed over the flexible self-sealing dispensing valve;

a third wall portion, wherein the third wall portion is disposed between the first wall portion and the second wall portion;

a first transverse heat seal disposed adjacent to a bottom edge of the first wall portion and extending between the first and opposing second side edges to form an inner bottom end margin of the first wall portion, and a second transverse heat seal disposed adjacent to the bottom edge of the second wall portion extending between the first and opposing second side edges of the pouch to form an inner bottom end margin of the second wall portion;

a first closure member affixed to the inner bottom end margin of the first wall portion, and a second closure member affixed to the inner bottom end margin of the second wall portion.

2. The pouch according to claim 1, further comprising a first longitudinal side heat seal disposed adjacent to the first side edge and extending between the top and opposing bottom edges, and a second longitudinal side heat seal disposed adjacent to the second side edge and extending between the top and opposing bottom edges.

3. The pouch according to claim 1, wherein the orifice consists of a hole through one of the first or second wall portions or a hole through the patch.

4. The pouch according to claim 1, wherein the flexible self-sealing dispensing valve consists of three, triangular-shaped sections formed by the two intersecting lines of weakness in other either one of the first and second wall portions or the patch.

5. The pouch according to claim 1, wherein the flexible self-sealing dispensing valve consists of four, triangular-shaped sections formed by the two intersecting lines of weakness in either one of the first and second wall portions or the patch.

6. The pouch according to claim 1, wherein the two intersecting lines of weakness do not extend through the entire thickness of either one of the first and second wall portions or the patch.

7. The pouch according to claim 1, further comprising an adhesive label applied to the outer surface of the pouch covering the discharge means.

8. The pouch according to claim 1, wherein the patch is an adhesive patch applied to the outer surface of the pouch.

9. The pouch according to claim 1, wherein the patch is an adhesive patch applied to the inside surface of the pouch.

10. The pouch according to claim 1, wherein the fluid product is a viscous food product.

* * * * *